US006447341B1

(12) United States Patent
Hyland

(10) Patent No.: US 6,447,341 B1
(45) Date of Patent: Sep. 10, 2002

(54) RJ MODULAR CONNECTOR HAVING SUBSTRATE HAVING CONDUCTIVE TRACE TO BALANCE ELECTRICAL COUPLINGS BETWEEN TERMINALS

(75) Inventor: James Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,101

(22) Filed: Dec. 28, 2001

Related U.S. Application Data

(63) Continuation-in-part of application No. 09/863,942, filed on May 22, 2001.

(51) Int. Cl.[7] ..... H01R 21/22
(52) U.S. Cl. ..... 439/676; 439/620; 439/941
(58) Field of Search ..... 439/676, 941, 439/620

(56) References Cited

U.S. PATENT DOCUMENTS 5,924,896 A * 7/1999 Arnett et al. ..... 439/676
6,276,943 B1 * 8/2001 Boutros et al. ..... 439/76.1
6,290,506 B1 * 9/2001 Milner ..... 439/3

* cited by examiner

*Primary Examiner*—Tho D. Ta
*Assistant Examiner*—Truc Nguyen
(74) *Attorney, Agent, or Firm*—Wei Te Chung

(57) ABSTRACT

An RJ modular connector (1) includes a housing (10) defining a terminal insert receiving space (12). A terminal insert (20) is received in the terminal insert receiving space (12) and includes a pair of substrates (3, 4) having a plurality of conductive traces (30*s*–30*t*, 30*s'*–30*t'*) formed on inner faces thereof and a plurality of terminals (21–28). One trace (30*s*) of the plurality of traces is aligned with only a selected terminal (21) soldered on the second face (32) of the substrate while extends over a parallel terminal (22) and is electrically connected to another selected terminal (23) thereby establishing electrical coupling between said two selected terminals by said trace.

12 Claims, 9 Drawing Sheets

RJ MODULAR CONNECTOR HAVING SUBSTRATE HAVING CONDUCTIVE TRACE TO BALANCE ELECTRICAL COUPLINGS BETWEEN TERMINALS

EXTEND OVER-REFERENCE TO RELATED APPLICATIONS

This application is a continuation-in-part (C-I-P) application of copending application Ser. No. 09/863,942 filed on May 22, 2001.

BACKGROUND OF THE INVENTION

1. Field of the Invention

The present invention relates to a RJ modular connector, and more particularly to a RJ modular connector having a substrate provided therein to balance electrical couplings between terminals.

2. Description of Related Art

RJ modular connector has been widely used in telecommunication system since it was firstly created. A so-called RJ45 modular connector has been widely used in the network system.

The RJ45 modular connector includes totally eight terminals. Resulting from miniaturization of the computer, all corresponding components, including connectors, have to be reduced for their dimension and size. One of the negative consequences or problem created from miniaturization is electrical coupling between terminals. When the RJ connector is used in low speed signal transmission, couplings between adjacent terminals can be ignored in light of its effect. However, when the RJ connector is used for high speed signal transmission, the couplings between adjacent terminals create a great problem. Unless the electrical coupling can be effectively controlled within an accepted level, it is unlikely that the RJ 45 modular connector can be used in the high-speed signal transmission.

One of the approaches is to select a pair of terminals as a differential pair. In the differential pair, two terminals transmit the same signal but with inverted phase. By this arrangement, a portion of the noise can be subtracted in a data processing unit.

As shown in an attached catalog from The Siemon Company, there are at least eight different patterns in selecting terminals as differential pair, i.e. T568A, T568B, USOC 4-pair, USOC 1-, 2- or 3-pair, 10 BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries a coupling issue need to be solved.

Among those patterns, T568A and T568B are widely used and in T568A, terminals 1, 2 configure 3rd pair, terminals 3, 6 configure 2nd pair, terminals 4, 5 configure 1st pair, while terminals 7, 8 configure 4th pair. In T568B, terminals 1, 2 configure 2nd pair, terminals 3, 6 configure 3rd pair, terminals 4, 5 configure 1st pair, while terminals 7, 8 configure 4th pair.

Since those eight terminals are equally spaced, electrical couplings between terminals will surely create some problems, i.e. coupling or crosstalk. For example, if we take terminal 3 into consideration, terminal 3 will naturally pick up energy coupled from terminals 2, and 4 which are close to terminal 3. On the other hand, terminal 6, which carries signal having inverted phase of the signal carried by terminal 3, will also pick up energy coupled from terminals 5 and 7. However, energy coupled into terminals 3, 6 from terminals 2 and 7 can not be suitably eliminated because terminals 3, 6 is unlikely to establish couplings between terminals 1 and terminals 8 to balance the couplings between terminals 2, 3 and 6, 7. Accordingly, signals transmitted by terminals 3, 6 carry noises generated by their adjacent terminals 2, 7. In addition, terminals 3 and 6 will also carry noises coupled thereto from terminals 4, 5 and which couplings should be also carefully taken to avoid certain noises.

In order to decrease the effects of electrical coupling between the (3rd, 4th) and (3rd, 2nd) terminals, and (6th, 5th) and (6th, 7th) terminals, many approaches have been provided, such as creating electrical couplings between 3rd and 1st terminals and 3rd and 5th terminals, to balance the electrical coupling between the 3rd and 2nd terminals and 3rd and 4th terminals, and creating electrical coupling between 6th and 8th terminals and 6th and 4th terminals to balance the electrical couplings between the 6th and 7th terminals and 6th and 5th terminals.

However, as mentioned above, those eight terminals are arranged in a common plane, it is impossible to create those balancing electrical couplings, i.e. (1st , 3rd), (3rd , 5th), and (4th , 6th), (6th , 8th) terminals when all terminals are located in the same level, it is unlikely to create any electrical channels therebetween to create those electrical couplings accordingly.

The Siemon Company, a US company, discloses a solution posted on the Internet, http://www.siemon.com/white_papers/99-08-30-through-hole.asp. A hard copy thereof is herein attached for reference.

As clearly shown in FIG. 4 of that reference, 6th and 2nd terminals are arranged in the first layer, while 8th, 5th, 4th, and 1st terminals are arranged in the second layer, and 7th and 3rd terminals are arranged in the third layer.

The 6th terminal in the first layer has a rectangular loop having its longitudinal sides aligned with terminals 4th and 8th located in the second layer, while terminal 3 in the third layer also has a rectangular loop having its longitudinal sides aligned with terminals 5th and 1st located in the second layer.

In addition, the right longitudinal loop side of the terminal 6th further includes a square corresponding to a square formed in terminal 4th. The left longitudinal loop side of the terminal 3 includes also a square with respect to the square formed on terminal 5th.

Arrangements suggested by Siemon are to increase the couplings between (1st, 3rd), (3rd, 5th), and (4th, 6th), (6th, 8th) terminals thereby helping to balance electrical couplings of the terminals.

However, those eight or four set sets of terminals are arranged in three different layers, and each set of terminals are separately divided by an insulative sheet material. This will no doubt increase the complexity of the connector.

In addition, there are different shapes and configurations among those eight terminals. Each terminal has its own shape which is different from each other, especially the 3rd and 6th terminals, each including the rectangular loop portion which overlap to corresponding terminals to create wanted electrical couplings. Each loop further forms the square to increase the electrical couplings with corresponding terminals having the square. The electrical couplings created can help to meet higher system requirements. The eight different configurations of the terminals will surely increase the difficulty and complexity in production.

There are some other approaches that including routing terminal tails of those 3rd, 6th and 4th, 5th terminals to alter their position and affect couplings between 3rd, 2nd and 3rd, 4th; and 6th, 5th, and 6th, 7th terminals. However routing terminal tails will inevitably increase the manufacturing cost.

U.S. Pat. No. 6,120,329 issued to Steinman on Sep. 19, 2000, discloses another approach to solve the above-addressed problem. Again, terminals are configured with different shapes and dimensions making the production complex.

U.S. Pat. No. 5,069,641 issued to Sakamoto et al. discloses a suggestion of using substrate in the RJ modular housing, however, it addresses to different issues.

SUMMARY OF THE INVENTION

It is an object of this invention to provide an RJ modular connector, and more particularly to a RJ modular connector having a pair of substrates with conductive traces provided thereon to balance electrical couplings between terminals.

It is still an object of this invention to provide a RJ modular connector which can be easily manufactured.

In order to achieve the objective set forth, an RJ modular connector in accordance with the present invention comprises a housing defining a plug receiving section, and a terminal insert receiving section. A terminal insert is received in the terminal insert receiving section and includes a pair of substrates having a plurality of conductive traces and solder pads on inner surfaces thereof and a plurality of terminals attached on the solder pads. Each trace has a large portion which is aligned with only a selected terminal attached on the inner surface of each substrate and a small portion which is electrically connected to another selected terminal by one corresponding solder pad whereby electrical coupling is established between said two selected terminals by said trace.

Other objects, advantages and novel features of the invention will become more apparent from the following detailed description when taken in conjunction with the accompanying drawings.

DETAILED DESCRIPTION OF THE INVENTION

Figure 1:
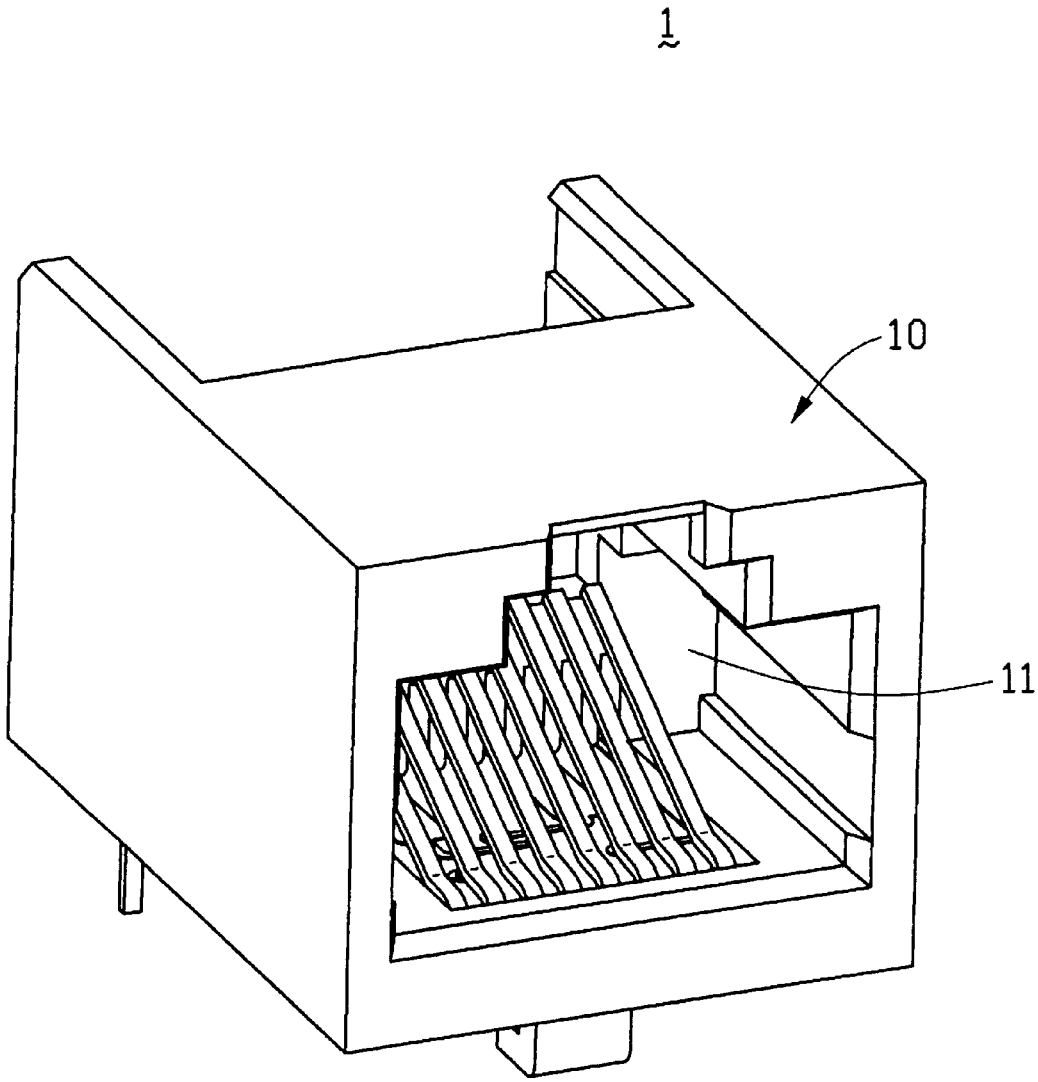
FIG. 1 is a perspective view of a RJ modular connector in accordance with the present invention.
Figure 2:
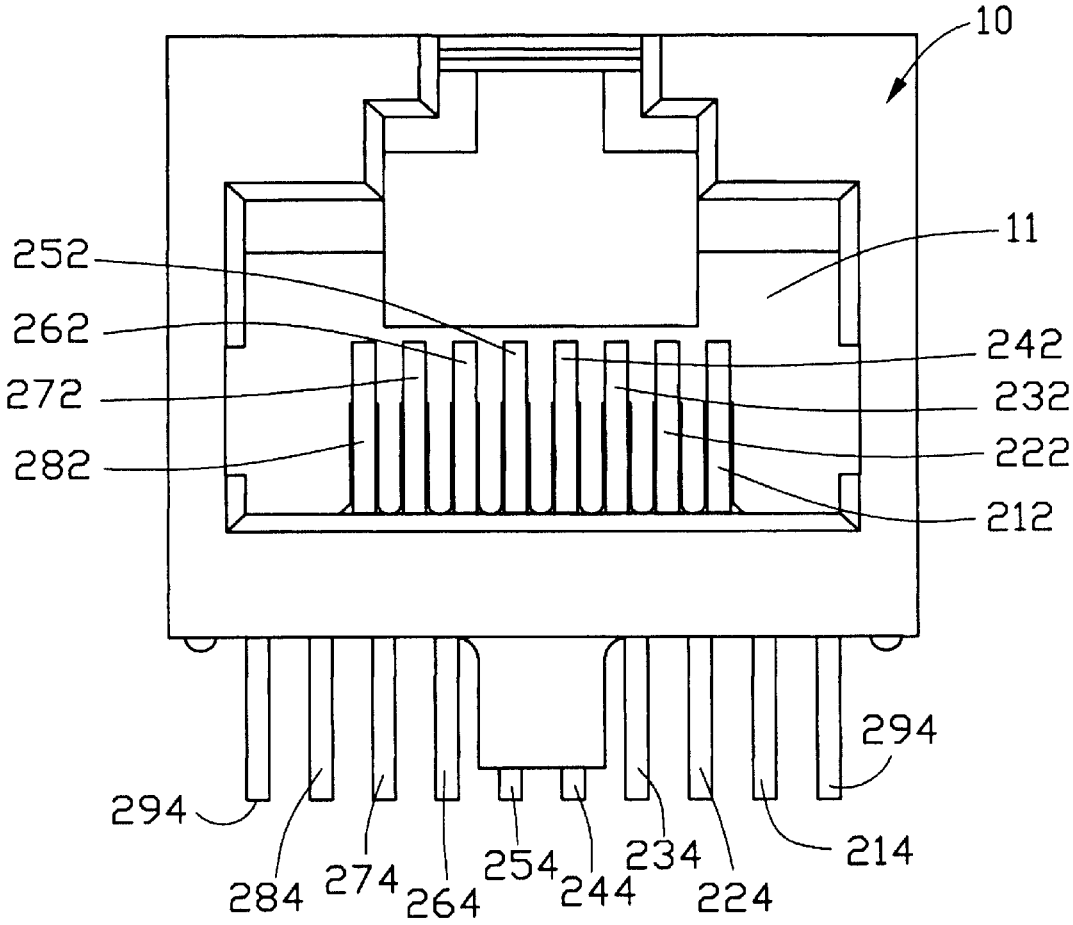
FIG. 2 is a front view of the RJ modular connector of FIG. 1.
Figure 3:
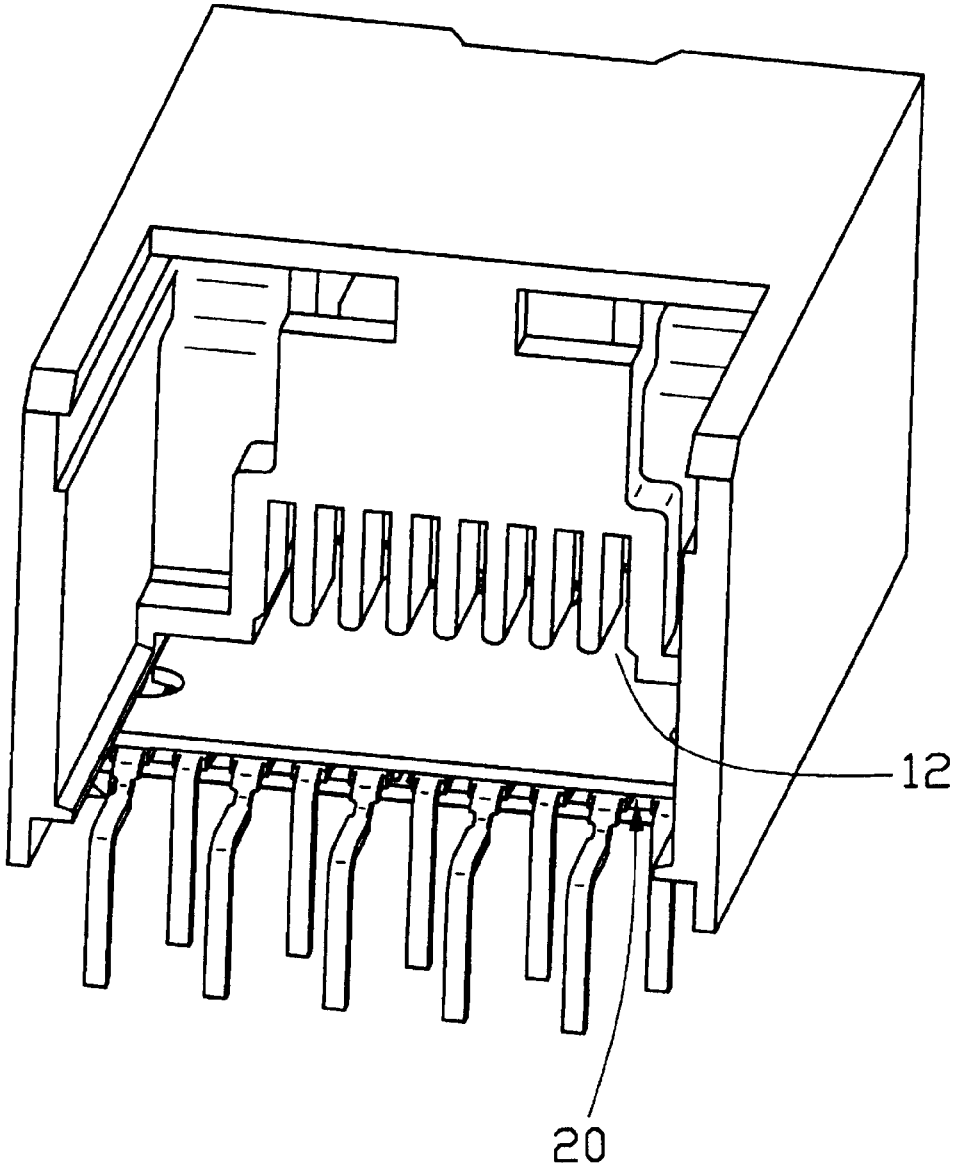
FIG. 3 is another perspective view of the RJ modular connector of FIG. 1.
Figure 4:
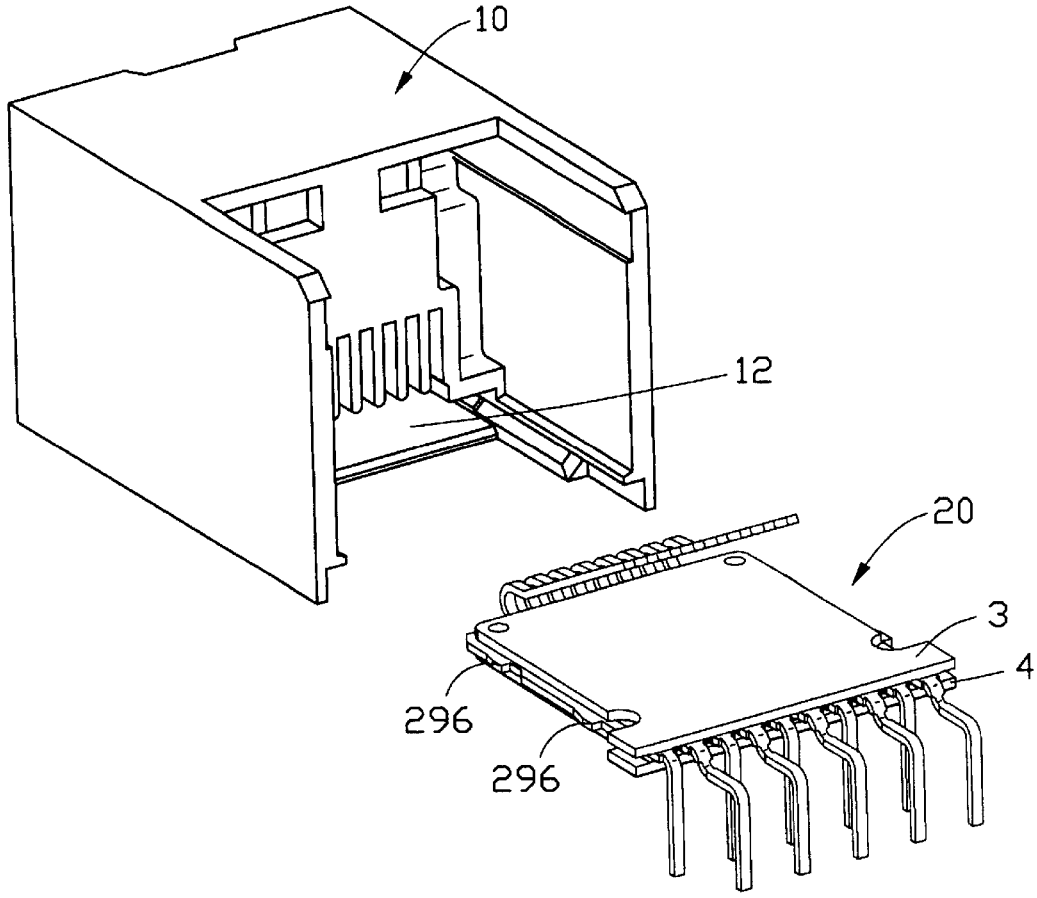
FIG. 4 is an exploded view of the modular connector to show a terminal insert and a housing of the modular connector.
Figure 5:
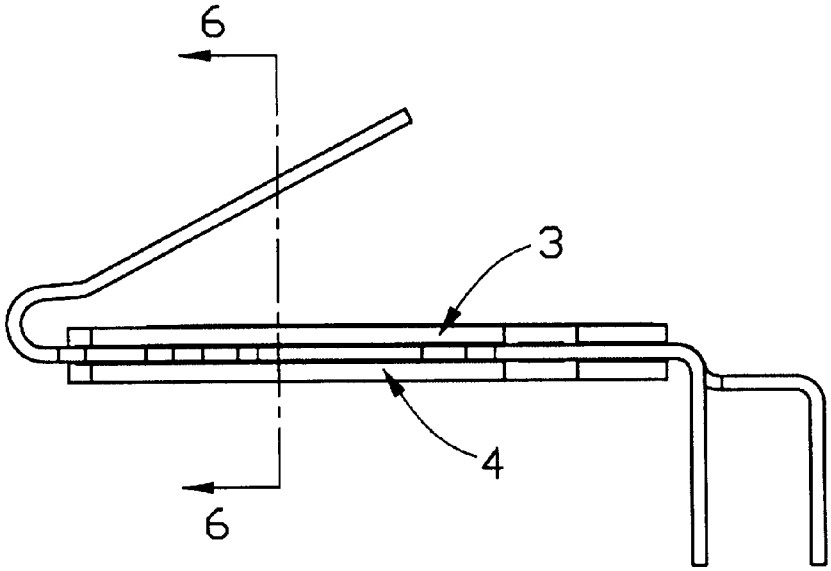
FIG. 5 is a side view of the terminal insert of the RJ modular connector of the present invention.
Figure 6:
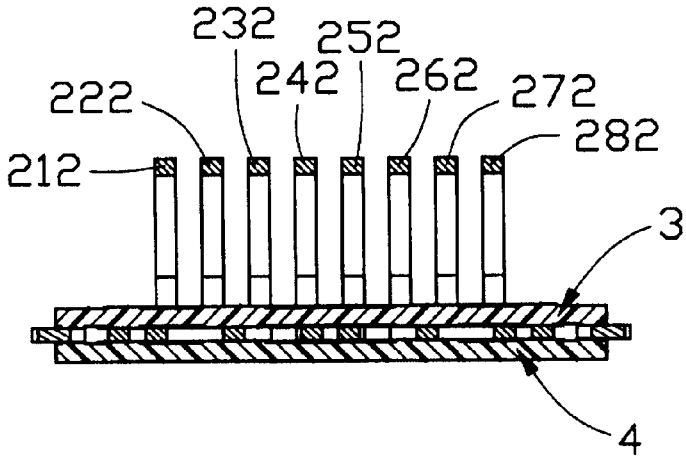
FIG. 6 is an extend over-sectional view of the terminal insert of FIG. 5 taken along line 6—6.

Referring to FIGS. 1–4, a RJ modular connector 1 in accordance with the present invention includes an insulative housing 10, and a modular terminal insert 20. The housing 10 defines a plug receiving space 11 in a front end for mating with a complement connector (not shown), and a terminal insert receiving space 12 in a rear end of the housing 10 for receiving the modular terminal insert 20 therein.

Referring to FIGS. 4–12, the modular terminal insert 20 comprises an upper substrate 3, a lower substrate 4, eight signal terminals 21, 22, 23, 24, 25, 26, 27 and 28 and two conductors 29 for being sandwiched between the upper substrate 3 and the lower substrate 4. The upper substrate 3 has an outer surface 31, an inner surface 32 opposite the outer surface 31, a first side 33, and a second side 34 opposite the first side 33. The outer surface 31 of the upper substrate 3 is made of conductive material which can help to prevent electrical influence to the modular jack connector 1. Among the signal terminals, signal terminals 21, 22 configures a first differential pair, signal terminals 23, 26 configures a second differential pair, signal terminals 24, 25 configures a third differential pair, while terminals 27, 28 configures a fourth differential pair.

The upper substrate 3 defines four conductive traces 30*s*, 30*n*, 30*m* and 30*t* on the inner surface 32 arranged side by side. The first and second traces 30*s* and 30*n* are close to the first side 33 of the substrate 3. The third and fourth traces 30*m* and 30*t* are close to the second side 34 of the substrate 3. Each of the four conductive traces 30*s*, 30*n*, 30*m* and 30*t* has a large portion 130*s*, 130*n*, 130*m* and 130*t* and a pair of small portions 230*s*, 230*n*, 230*m* and 230*t* connected to a pair of ends of the large portion 130*s*, 130*n*, 130*m* and 130*t*. The first and second small traces 230*s* and 230*n* are extended toward the second side 34 of the upper substrate 3. The third and fourth small traces 230*m* and 230*t* are extended toward the first side 33 of the upper substrate 3. The large portion 130*n*, 130*m* all have a first width wide enough for helping electrical coupling, and the large portion 130*s*, 130*t* all have a second width wide enough for helping electrical coupling. The first width is larger than the second width.

Figure 9:
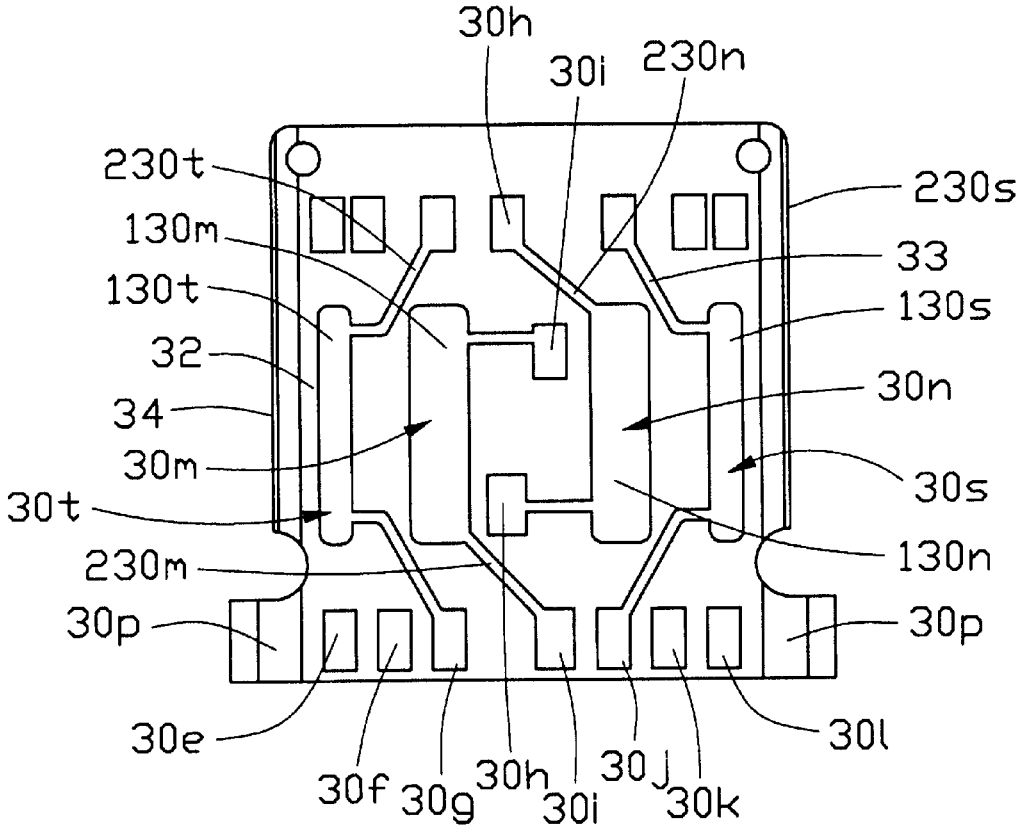
FIG. 9 is a bottom view of the upper substrate of the terminal insert of FIG. 7.
Figure 10:
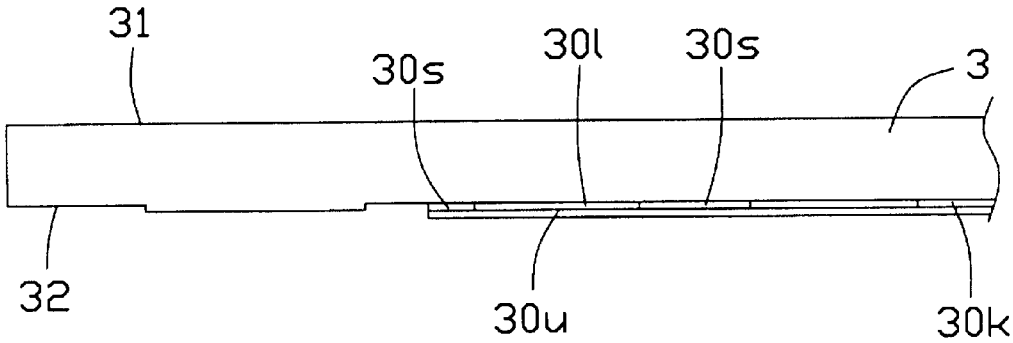
FIG. 10 is an enlarge side view of a left part of the upper substrate of FIG. 9.

Referring to FIG. 9, the upper substrate 3 has eight pairs of solder pads 30*l*, 30*k*, 30*j*, 30*i*, 30*h*, 30*g*, 30*f*, 30*e* on the inner surface 32 thereof. Each small portion 230*s*, 230*n*, 230*m* and 230*t* electrically connects with the solder pad 30*j*, 30*h*, 30*i* and 30*g*. A pair of electrical traces 30*p* is defined on the inner surface 32 of the upper substrate 3 separately completely extending along the first side 33 and the second side 34.

Figure 11:
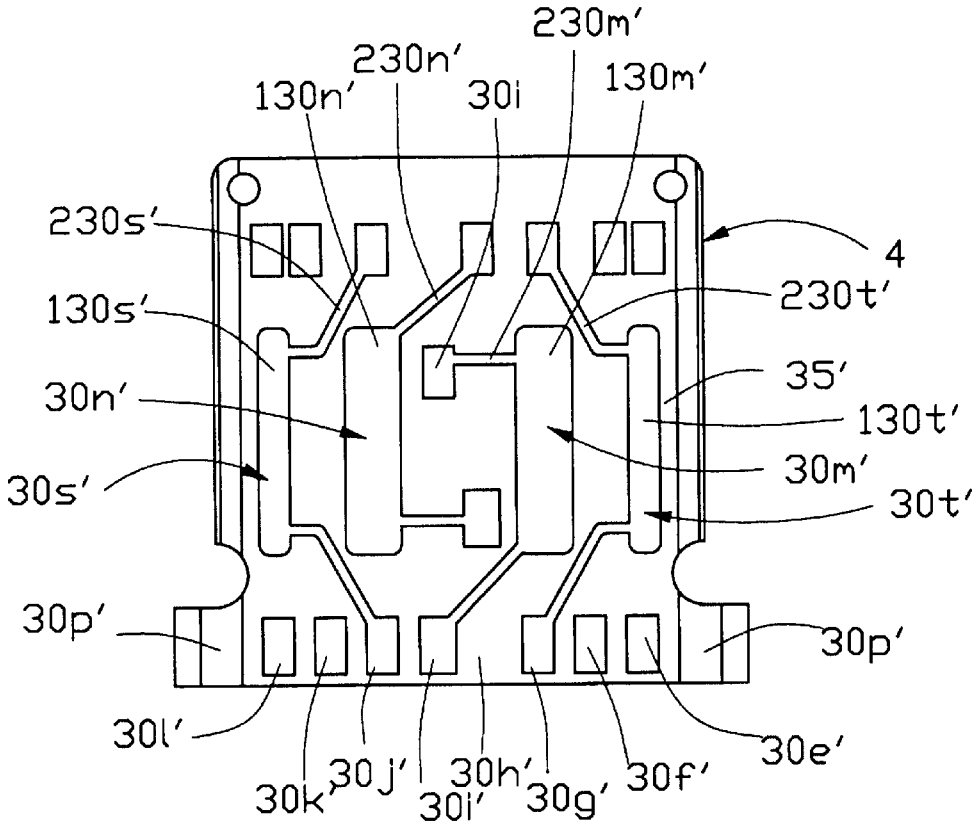
FIG. 11 is a top view of the lower substrate of the terminal insert of FIG. 7.
Figure 12:
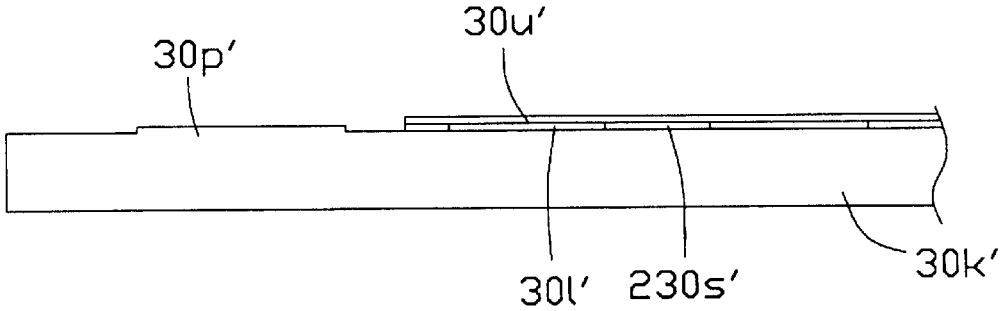
FIG. 12 is an enlarge side view of a left part of the lower substrate of FIG. 11.

Referring to FIG. 11, the lower substrate 4 has an outer surface (not labeled) and an inner surface 35' having a symmetrical structure with the inner surface 32 of the upper substrate 3. Four conductive traces 30*s*', 30*n*', 30*m*' and 30*t*' are formed on the inner surface 35' of the lower substrate 4 corresponding to the conductive traces 30*s*, 30*n*, 30*m* and 30*t* of the upper substrate 3, and eight pairs of solder pads 30*l*', 30*k*', 30*j*', 30*i*', 30*h*', 30*g*', 30*f*' and 30*e*' are also formed on the inner surface 35' corresponding to the solder pads 30*l*, 30*k*, 30*j*, 30*i*, 30*h*, 30*g*, 30*f*, 30*e* and 30*p* of the inner surface 32 of the upper substrate 3. Each of the four conductive traces 30*s*', 30*n*', 30*m*' and 30*t*' has a large portion 130*s*', 130*n*', 130*m*' and 130*t*' and a pair of small portions 230*s*', 230*n*', 230*m*' and 230*t*' connected to a pair of ends of the large portion 130*s*', 130*n*', 130*m*' and 130*t*'. Each small portion 230*s*', 230*n*', 230*m*' and 230*t*' electrically connects with the solder pad 30*j*', 30*h*', 30*i*' and 30*g*'. The outer surface of the lower substrate 4 is made of conductive material, which can help to prevent electrical influence to the modular jack connector 1.

Figure 7:
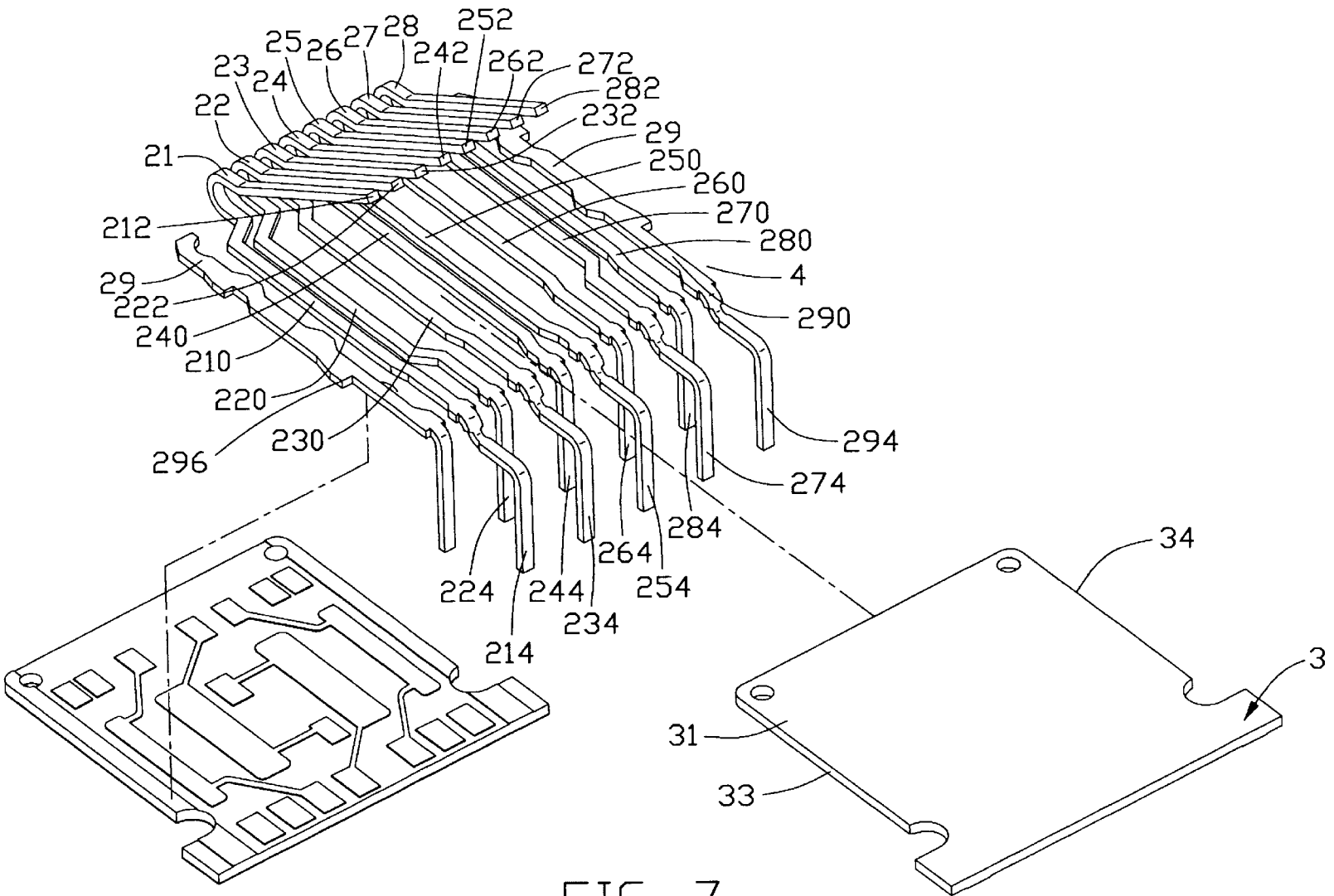
FIG. 7 is an exploded view of the terminal insert with an upper and a lower substrates separating therefrom.
Figure 8:
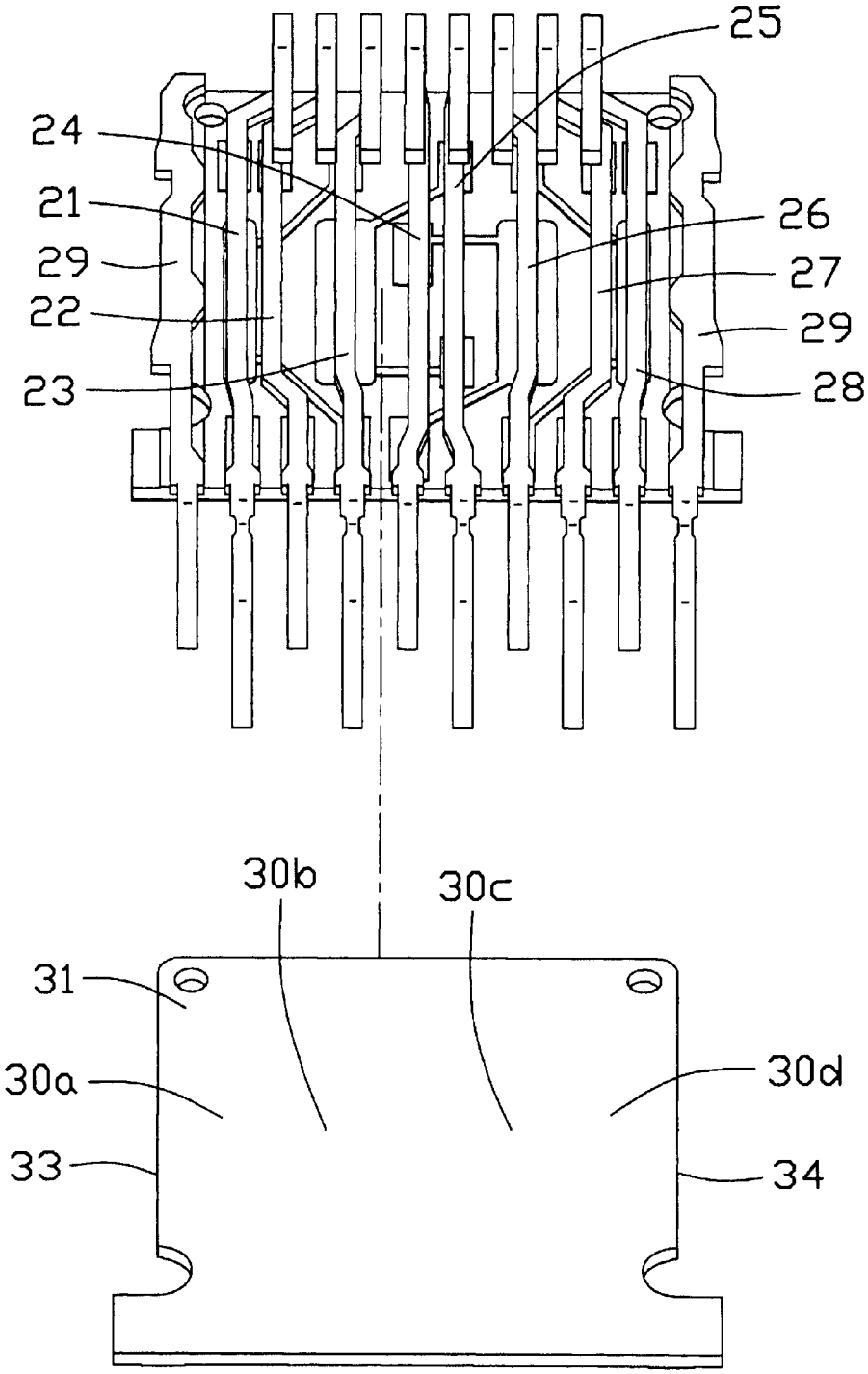
FIG. 8 is another exploded view of the terminal insert with the upper substrate separating therefrom.

Referring to FIGS. 7 and 8, each signal terminal 21, 22, 23, 24, 25, 26, 27 and 28 has a middle portion 210, 220, 230, 240, 250, 260, 270 and 280, a contact portion 212, 222, 232, 242, 252, 262, 272 and 282 at one end of the middle portion and being bent to an angle and a solder portion 214, 224, 234, 244, 254, 264, 274 and 284 bending downwardly for being soldered to a mother board (not shown). A first distance between one terminal of the first, third, fourth differential pairs signal terminals 21, 22, 24, 25, 27 and 28 to one terminal of the second differential pair signal terminals 23 and 26 is larger than a second distance between the two terminals adjacent to each other in one differential pair terminals 21 and 22 or 24 and 25 or 27 and 28. Each conductor 29 has a side beam 290 and a ground tail 294 bending downwardly for being soldered to the motherboard. The ground tail 294 will bring ground into the modular terminal insert 20 from the motherboard. Each side beam 290 has a plurality of barbs 296 for interfering with the housing 10 and securing the modular terminal insert 20 to the housing 10.

The middle portions 210, 220, 230, 240, 250, 260, 270, 280 and the side beams 290 of the signal terminals and conductors 21, 22, 23, 24, 25, 26, 27, 28 and 29 are surface mounted on the solder pads and electrical traces of the upper surface of the lower substrate 4 side by side. The signal terminals and conductors 21, 22, 23, 24, 25, 26, 27, 28 and 29 are correspondingly soldered with the solder pads 30*l*', 30*k*', 30*j*', 30*i*', 30*h*', 30*g*', 30*f*', 30*e*' and 30*p*' of the inner surface 32 of the upper substrate 3 and the solder pads 30*l*', 30*k*', 30*j*', 30*i*', 30*h*', 30*g*', 30*f*', 30*e*' and 30*p*' of the inner surface 35' of the lower substrate 4 whereby the first traces 30*s*, 30*s*' align with the first terminal 21, the second traces 30*n*, 30*n*' align with the third terminal 23, the third traces 30*m*, 30*m*' align with the sixth terminal 26 and the fourth traces 30*t*, 30*t*' align with the eighth terminal 28. The side beams 290 increase the solder area with the upper and the lower substrates 3 and 4 and are securely soldered with the upper and lower substrates 3 and 4 together. The small portions 230*n*, 230*n*' of the second traces 30*n*, 30*n*' on the inner surfaces 32, 35' of the upper and lower substrates 3, 4 extend over the fourth signal terminal 24 on the inner surfaces 32 and 35', and the small portions 230*m* and 230*m*' of the third traces 30*m* and 30*m*' on the inner surface 32 and 35' of the upper and lower substrates 3 and 4 extend over the fifth signal terminal 25 on the inner surfaces 32 and 35'.

Referring to FIGS. 9 to 12, each trace 30*s*, 30*s*', 30*n*, 30*n*', 30*m*, 30*m*', 30*t* and 30*t*' has an insulative film 30*v* and 30*v*' attached thereon for insulating the trace.

Because electrical coupling between the first signal terminal 21 and the third signal terminal 23 is established, electrical influence to the third signal terminal 23 created by the second signal terminal 22 can be better balanced to help improve crosstalk performance. Because electrical coupling between the third signal terminal 23 and the fifth signal terminal 25 is established, electrical influence to the third signal terminal 23 created by the fourth signal terminal 24 can be better balanced to help improve crosstalk performance. Because electrical coupling between the fourth signal terminal 24 and the sixth signal terminal 26 is established, electrical influence to the sixth signal terminal 26 created by the fifth signal terminal 25 can be better balanced to help improve crosstalk performance. Because electrical coupling between the sixth signal terminal 26 and the eighth signal terminal 28 is established, electrical influence to the sixth signal terminal 26 created by the seventh signal terminal 27 can be better balanced to help improve crosstalk performance. The conductors 29 are correspondingly soldered on the first and second sides 33, 34 of the upper substrate 3 to connect the upper substrate 3 and the lower substrate 4 together and possibly bring ground into the modular terminal insert 20.

The modular terminal insert 20 is correspondingly inserted and secured in the terminal insert receiving space 12 of the housing 10 with the barbs 296 of the conductors 29 interfering with the housing 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A RJ modular connector, comprising:

a housing defining a plug receiving section, and a terminal insert receiving section;

a terminal insert received in the terminal insert receiving section, the terminal insert being configured by at least one substrate and a plurality of signal terminals attached to the at least one substrate, each substrate having a plurality of traces and a plurality of solder pads on an inner surface thereof with the terminals correspondingly attached thereto; and wherein one trace of the plurality of traces is aligned with a selected terminal and electrically connects another selected terminal whereby electrical coupling is established between these two selected terminals by said trace, wherein each trace on the inner surface of each substrate has a large portion aligning with the selected terminal and at least one small portion connected with one end of the large portion and one solder pad with the selected terminal soldered thereto;

wherein a parallel terminal of said plurality of signal terminals is located between the selected terminal coupling with each other by the trace;

wherein the small portion extends over the parallel terminal located between said selected terminal.

2. The RJ modular connector as claimed in claim 1, wherein the large portion of the trace has a width wide enough for increasing coupling effect.

3. The RJ modular connector as claimed in claim 2, wherein large portions of a first group of the traces all have a first width, and large portions of a second group of the traces all have a second width, the first width is larger than the second width.

4. The RJ modular connector as claimed in claim 1, wherein each substrate has a conductive outer surface for preventing electrical influence.

5. The RJ modular connector as claimed in claim 1, wherein the connector further comprises at least one conductor, and each conductor has a side beam being attached to each substrate.

6. The RJ modular connector as claimed in claim 5, wherein said side beam of the conductor further comprises a plurality of barbs interfering with the housing of the modular connector thereby securing the terminal insert to the housing.

7. The RJ modular connector as claimed in claim 6, wherein the conductor further comprises a ground tail connecting the ground from the motherboard to the terminal insert.

8. A RJ modular connector, comprising:

a housing defining a plug receiving section, and a terminal insert receiving section;

a terminal insert received in the terminal insert receiving section, the terminal insert being configured by a first substrate and a plurality of signal terminals attached to the first substrate, the first substrate having a plurality of traces and a plurality of solder pads on an inner surface thereof with the terminals correspondingly attached thereto; and wherein one trace of the plurality of traces is aligned with a selected terminal and electrically connects another selected terminal whereby electrical coupling is established between these two selected terminals by said trace, wherein each trace on the inner surface of each substrate has a large portion aligning with the selected terminal and at least one small portion connected with one end of the large portion and one solder pad with the selected terminal soldered thereto;

wherein a parallel terminal of said plurality of signal terminals is located between the selected terminal coupling with each other by the trace;

wherein the small portion extends over the parallel terminal located between said selected terminal.

9. The RJ modular connector as claimed in claim 8, wherein the RJ modular connector further comprises a second substrate together with the first substrate sandwiching the terminals therebetween.

10. The RJ modular connector as claimed in claim 9, wherein the second substrate has a plurality of traces and a plurality of solder pads on an inner surface thereof, the traces and the solder pads have symmetrical structures with that formed on the inner face of the first substrate.

11. The RJ modular connector as claimed in claim 10, wherein the first and second substrates all have conductive outer surfaces for preventing electrical influence.

12. An electrical connector comprising:

an insulative housing;

a terminal insert disposed in the housing;

said terminal insert including:

at least one substrate with conductive traces thereon;

a plurality of juxtaposed terminals each including a contact portion, a solder portion and a horizontal connection portion therebetween seated upon said substrate and extending along a front-to-back direction;

a first terminal of said terminals electrically connected to a first trace of said traces, said first trace extending in one lateral direction away from said first terminal toward a second terminal which is located on one side of and spaced from the first terminal with a third terminal therebetween, said first trace including an enlarged portion extending in alignment with said second terminal along said front-to-back direction for intentionally generating crosstalk between the first terminal and the second terminal to somewhat counterbalance another crosstalk derive between the first terminal and the third terminal; and a second trace electrically connected to a fourth terminal which is located on the other side of and spaced from the first terminals with a fifth terminal therebetween, said second trace extending in said lateral direction away from said fourth terminal toward said first terminal, and said second trace including an enlarged portion extending in alignment with said first terminal along said front-to-back direction for intentionally generating crosstalk between the first terminal and the fourth terminal to somewhat counterbalance another crosstalk derived between the first terminal and the fifth terminal, wherein said traces further include at least one small portion connected with one end of the enlarged portion and one solder pad with a selected terminal of said terminals soldered thereto.

* * * * *